US006481139B2

(12) United States Patent
Weldle

(10) Patent No.: US 6,481,139 B2
(45) Date of Patent: Nov. 19, 2002

(54) HANDGUN WITH A COCKING ACTUATOR SAFETY

(75) Inventor: Helmut Weldle, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/991,060

(22) Filed: Nov. 21, 2001

(65) Prior Publication Data

US 2002/0073593 A1 Jun. 20, 2002

Related U.S. Application Data

(63) Continuation of application No. PCT/EP01/02577, filed on Mar. 7, 2000.

(51) Int. Cl.[7] ..... F41A 17/00
(52) U.S. Cl. ..... 42/70.08; 42/69.03
(58) Field of Search ..... 42/69.03, 66, 70.08, 42/70.05, 70.01

(56) References Cited

U.S. PATENT DOCUMENTS

| | | | | | |
|---|---|---|---|---|---|
| 3,726,040 | A | * | 4/1973 | Cranston | 42/69.01 |
| 4,028,836 | A | * | 6/1977 | Keppeler | 42/69.03 |
| 4,282,795 | A | * | 8/1981 | Beretta | 42/70.08 |
| 4,312,263 | A | * | 1/1982 | Bourlet | 42/70.08 |
| 4,392,319 | A | * | 7/1983 | Ottolini | 42/17 |
| 4,589,377 | A | * | 5/1986 | Van Dal | 123/25 C |
| 4,615,133 | A | * | 10/1986 | Center | 42/69.01 |
| 4,706,401 | A | * | 11/1987 | Nielsen | 42/69.03 |
| 5,160,796 | A | * | 11/1992 | Tuma et al. | 42/69.03 |
| 5,166,458 | A | * | 11/1992 | Yoo | 42/69.03 |
| 5,216,195 | A | * | 6/1993 | Tuma | 42/69.03 |
| 5,303,494 | A | * | 4/1994 | Tuma et al. | 42/69.03 |
| 5,400,537 | A | * | 3/1995 | Meller et al. | 42/69.03 |
| 5,915,935 | A | * | 6/1999 | Weldle et al. | 42/45 |
| 6,412,206 | B1 | * | 7/2002 | Strayer | 42/69.03 |

FOREIGN PATENT DOCUMENTS

| | | | | |
|---|---|---|---|---|
| DE | 197 32 857 C1 | | 10/1998 | F41A/19/42 |
| EP | 0013583 B1 | * | 1/1980 | 42/69.03 |
| EP | 0143114 A1 | * | 6/1985 | F41C/19/00 |
| EP | 01594356 | * | 9/1985 | 42/69.03 |
| EP | 0 982 557 A2 | | 3/2000 | F41A/19/48 |
| WO | WO 82/03910 | * | 11/1982 | 42/69.03 |
| WO | WO 98/51984 | | 11/1998 | F41A/17/74 |
| WO | WO 01/73367 | | 3/2001 | F41A/17/74 |

OTHER PUBLICATIONS

*International Search Report* corresponding to International Patent Application Serial No. PCT/EP01/02577, European Patent Office, dated Jun. 28, 2001, 3 pages.

* cited by examiner

*Primary Examiner*—Michael J. Carone
*Assistant Examiner*—Denise J Buckley
(74) *Attorney, Agent, or Firm*—Marshall, Gerstein & Borun

(57) ABSTRACT

A firearm is described which has a trigger mechanism, a cock and a cocking actuator that is separate from the cock. A striker spring acts on the cocking actuator to drive the cock. A cocking actuator safety mechanism, which is independent of the trigger mechanism, is provided for securing the cocking actuator in its cocked position. The illustrated safety mechanism has an operating handle which sits next to the lug of the cock, so that the safety mechanism can optionally be operated together with the cock.

11 Claims, 3 Drawing Sheets

HANDGUN WITH A COCKING ACTUATOR SAFETY

RELATED APPLICATION

This patent is a continuation under 35 U.S.C. §120 from International Application Ser. No. PCT/EP01/02577, filed Mar. 7, 2000.

FIELD OF THE INVENTION

The invention relates generally to firearms, and, more particularly, to a handgun with a cock, a cocking actuator which is separate from the cock and a safety mechanism for releasably securing the cocking actuator in a cocked position.

BACKGROUND OF THE INVENTION

As used herein, terms pertaining to position, such as "top," "forward," etc. refer to the weapon in a normal horizontal position. Thus, "forward" refers to the direction of shooting.

A prior art handgun is known from German Patent 197 32 857 C1.

A gun has recently become known (Daewoo, Korea) in which the cock is designed in two parts, namely, an actual cock and a cocking actuator. The cock has a handle or lug which can be gripped for cocking the mechanism. The cocking actuator is connected to and driven by the striker spring. The cocking actuator acts on the cock. The trigger mechanism of this gun acts on the cock via a tension trigger mechanism (double-action device), while the locking mechanism which releases the shot if the weapon has first been cocked (single-action locking mechanism) is arranged on the cocking actuator.

Thus, in operation of the tension trigger, the cock is moved to the rear and entrains the cocking actuator. In operation of the trigger when the cocking actuator has first been cocked, the cocking actuator strikes off and entrains the cock.

The advantage of this arrangement is that when the cocking actuator is cocked, the cock can simply move back into its forward end position. It is only necessary to overcome the set frictional resistance. Thus, the cock does not become caught when removing the weapon from an article of clothing, for example. Nevertheless, when shooting, only the low trigger weight of the cocked weapon need be overcome. In forward movement of the cock when the cocking actuator is cocked against the set frictional resistance, the trigger moves back into the forward position (double-action position) which corresponds to the uncocked weapon. However, in pulling the trigger, only the aforementioned low frictional resistance need be overcome by the trigger until the trigger then releases the cocking actuator when the cock moves back and, thus, the shot is released.

In the position just described (cocking actuator cocked, cock forward) the trigger is in the forward position (double-action trigger position) and is thus a great distance from the pressure point (single-action trigger position), so that a greater measure of safety is achieved than with a conventional cocked gun. It is nevertheless conceivable for the cocked cocking actuator to be released inadvertently from the locking mechanism (single-action locking mechanism), for example, due to a heavy vibration such as that when the gun is dropped onto the hard ground. Although under such a circumstance the cocking actuator will strike against the cock (which has a considerable mass and is at rest in its forward position after traveling its striking distance), in the worst case it could nevertheless fire a cartridge. Even if the cock were then secured, the cartridge could still be released if the safety were to fail.

This problem has been further intensified by the fact that many users use the tension trigger of the known gun only in the event of a cartridge failure. They do not release the cocking actuator in the usual use of the gun, but instead they only push the cock forward. Thus, they are actually carrying the cocked gun. However, firing should actually be prevented by the cock.

SUMMARY OF THE INVENTION

In accordance with an aspect of the invention, a handgun is provided which includes a trigger mechanism; a cock for movement between a first cocked position and a first discharged position; and a cocking actuator which is separate from the cock. The cocking actuator has a second cocked position and a second discharged position. The handgun further includes a striker spring loading the cocking actuator toward the discharged position; and a safety mechanism for releasably securing the cocking actuator in the cocked position. The safety mechanism is independent of the trigger mechanism such that actuating the trigger mechanism will not move the cocking actuator from the cocked position unless the safety mechanism releases the cocking actuator.

In accordance with another aspect of the invention, a safety mechanism is provided for use in a firearm including a trigger mechanism, a cock for movement between a first cocked position and a first discharged position, and a cocking actuator which is separate from the cock. The safety mechanism comprises an angle lever including a first arm and a second arm. The first arm is positioned in a substantially horizontal position and the second arm is positioned in a substantially vertical position. The second arm has an end positioned to releasably engage the cocking actuator for releasably securing the cocking actuator in the cocked position. The first arm includes an operating handle for selectively pivoting the angle lever to disengage the first end from the cocking actuator.

Other features and advantages are inherent in the disclosed apparatus or will become apparent to those skilled in the art from the following detailed description and its accompanying drawings.

DESCRIPTION OF THE PREFERRED EMBODIMENTS

Figure 1:
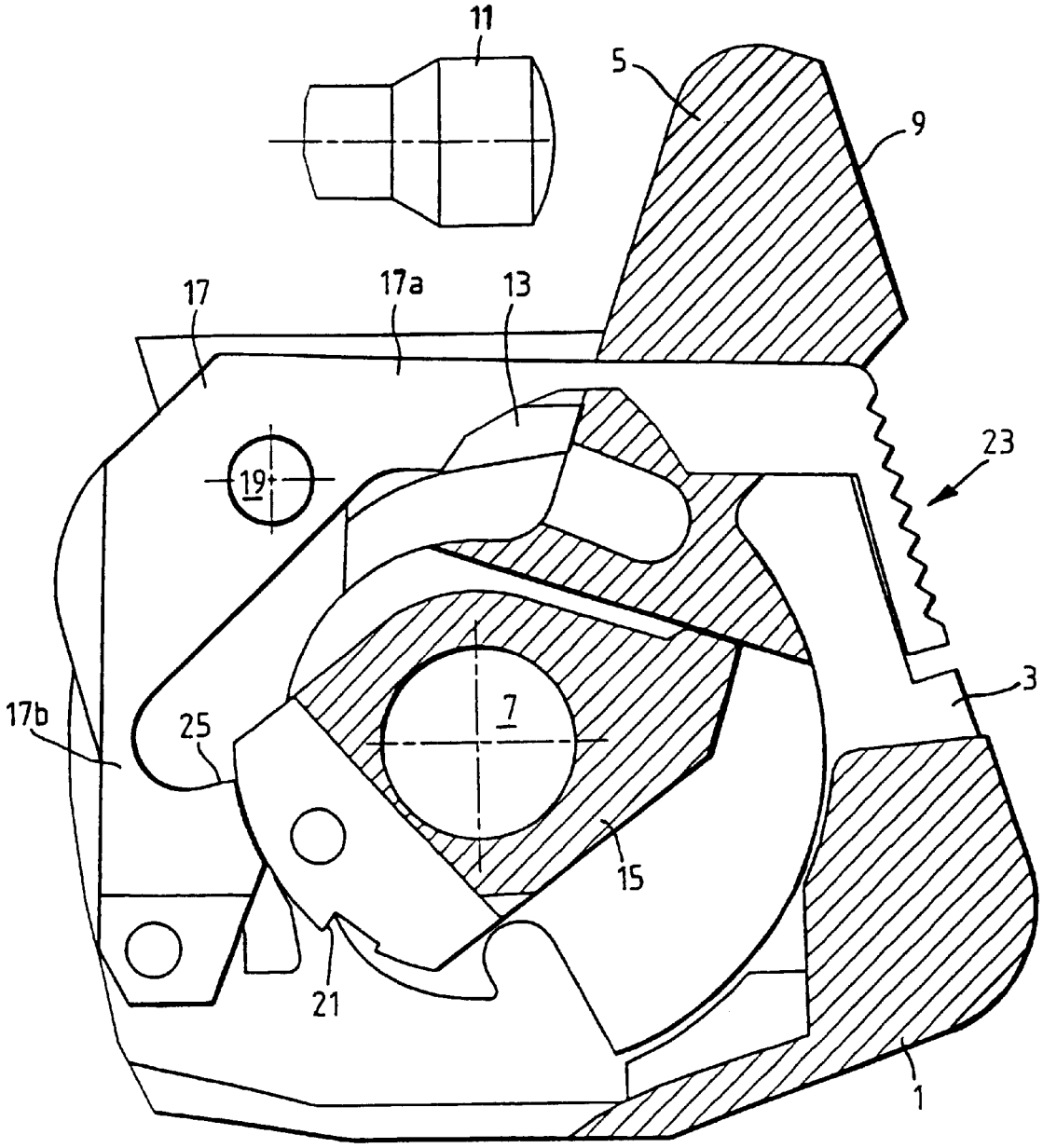
FIG. 1 is a longitudinal section through the rear portion of the handle of an automatic pistol constructed in accordance with the teachings of the invention and shown with the cocking actuator released (some parts have been omitted for the sake of simplicity).
Figure 2:
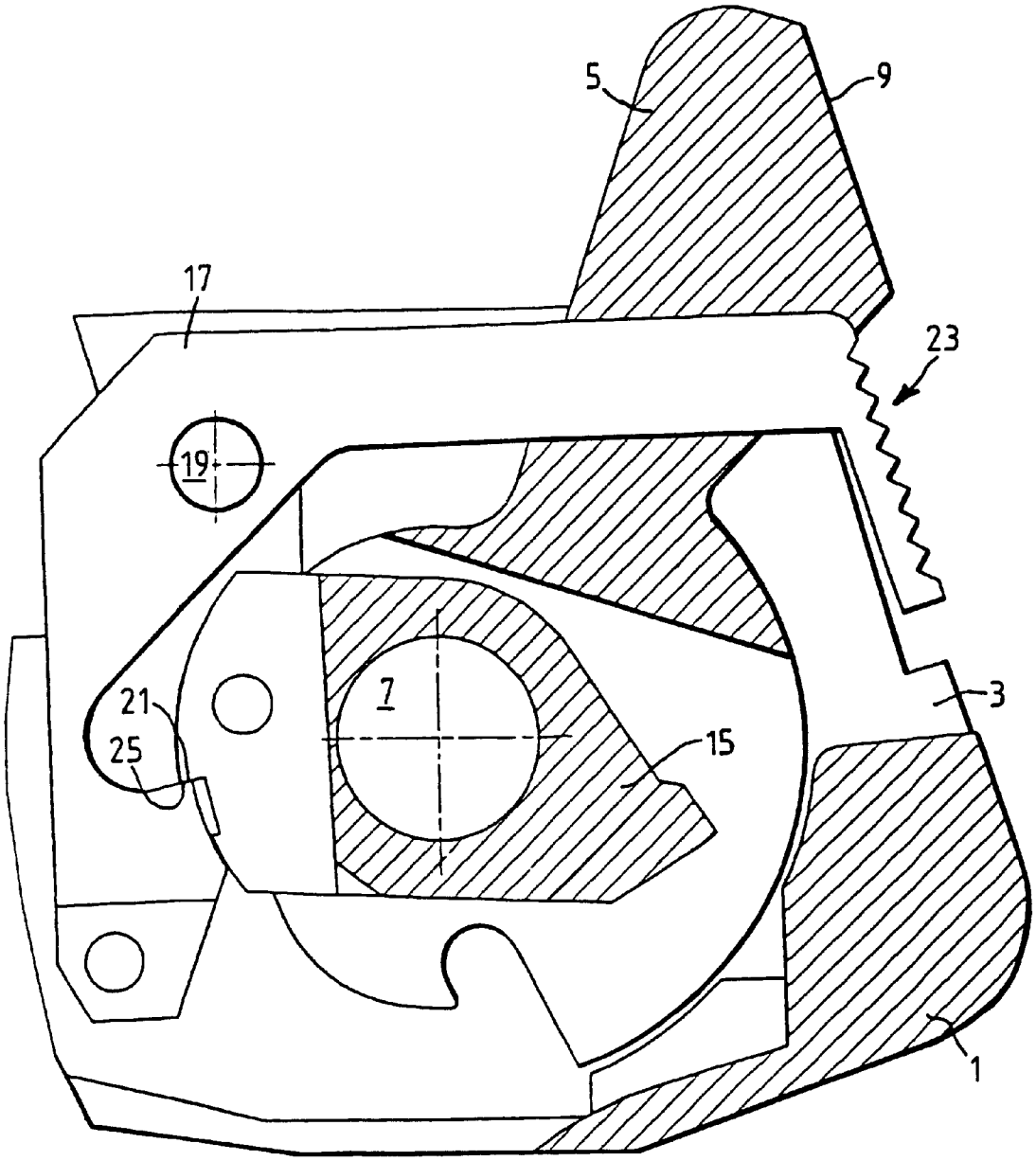
FIG. 2 is a view similar to FIG. 1 but showing the cocking actuator cocked and simplified even further.

In FIGS. 1 and 2, the rear portion of a handle 1 of an automatic pistol is shown in longitudinal section. This handle 1 has a recess 3 in which the cock 5 is disposed for pivoting movement about an axis 7 of the cock. For the sake of simplicity, the axis 7 of the cock 5 is not shown with cross-hatching. The cock 5 has a lug or projection 9 which projects to the rear beyond the handle 1 when the cock 5 is pivoted back into the recess 3. The projection 9 can be gripped by a user's hand that is holding the handle 1 in the shooting position.

Upon pivoting forward, the cock 5 can strike a firing pin 11 and, thus, fire a cartridge (not shown). FIGS. 1 and 2 show the cock 5 secured in a position that is not all the way forward in the discharge position as shown by the separation between the pin 11 and the cock 5. Instead, the cock 5 sits on a catch 13 which prevents the cock 5 from moving forward to reach the firing pin 11 (i.e., holds the cock 5 in an intermediate position between the cocked and discharge positions). This catch 13 forms a "firing pin piece safety mechanism" such as that known previously in the related art.

Figure 3:
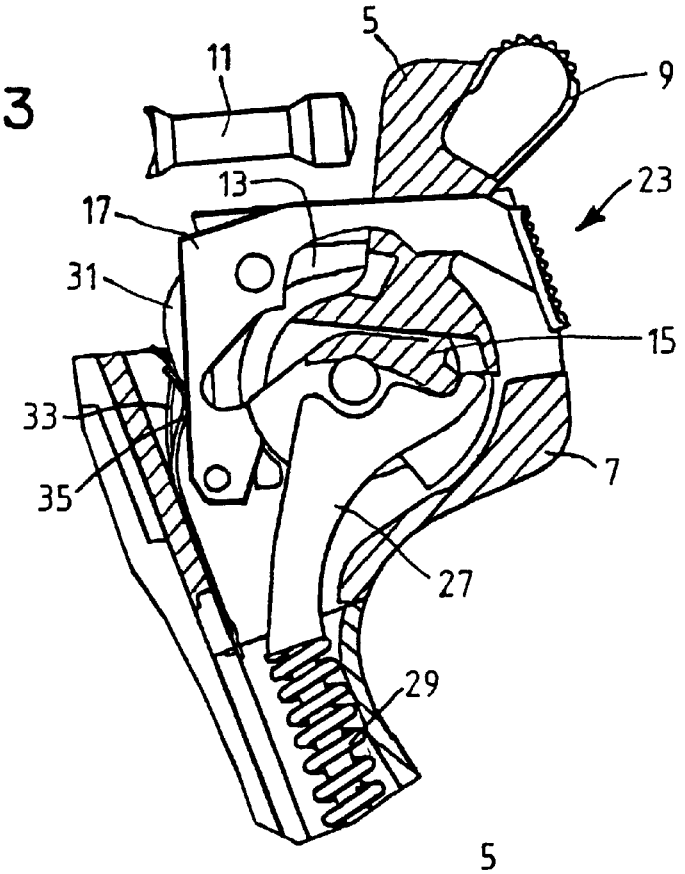
FIG. 3 is a more detailed view of the safety mechanism of FIGS. 1–2, showing the mechanism in the uncocked position.
Figure 4:
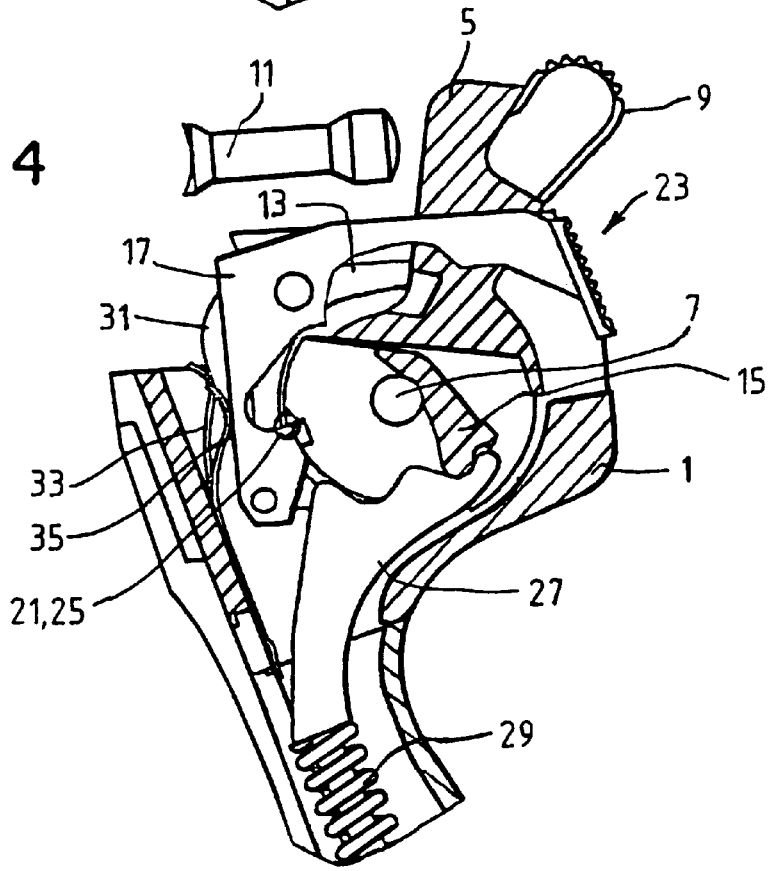
FIG. 4 is a view similar to FIG. 3, but showing the safety mechanism in the cocked position.

In a lower recess in the cock 5 sits a cocking actuator 15. Cocking actuator 15 can also be pivoted about the axis 7 of the cock 5. The cocking actuator 15 is biased by a striker spring 29 via a cocking rod 27 (see FIGS. 3 and 4) in the striking direction of the cock 5. In the cocked position, the cocking actuator 15 can be engaged in a trigger catch 31 (see FIGS. 3–4). In FIG. 1, the cocking actuator 15 is uncocked and, therefore, sits in engagement with the cock 5.

An angle lever 17 is provided having two legs 17*a*, 17*b* of approximately equal length arranged approximately at a right angle to one another. This lever 17 sits pivotably on a transverse axle 19 which is mounted in the handle 1 in front of, and above, the axis 7 of the cock 5, but in parallel with the axis 7. The angle lever 17 is provided with a bore approximately in the area of the angle between the two legs. The lever 17 sits pivotably on the transverse axle 19.

The angle lever 17 is under a constant load by a plate spring 35 (see FIGS. 3 and 4) in the direction toward the cocking actuator 15.

The leg 17*b* of the angle lever 17 has a catch projection 25 on its rear edge. The catch projection 25 is positioned to engage in a projection 21 on the cocked cocking actuator 15 (see FIG. 2). On the end of the other leg 17*a* of the angle lever 17 (i.e., the leg pointing toward the rear of the weapon) there is a web 23. The web 23 is provided with grooving and is angled downward on the outside. It serves as an operating handle 23.

The approximately horizontal leg 17*a* of the angle lever 17 is shown partially broken away in FIG. 1 to illustrate the catch 13.

The angle lever 17 is secured in the position shown in FIG. 1 by a catch mechanism so that the pivoting movement of the cocking actuator 15 is not hindered. In the uncocked position of the cocking actuator 15 shown in FIG. 1, the angle lever 17 is secured in the position shown. Therefore, the operating handle 23 cannot be moved. However, if the cocking actuator 15 is cocked, then its projection 21 is exactly behind the catch projection 25. Then if the operating handle 23 is pushed upward, the catch projection 25 extends beneath projection 21 and thus holds the cocking actuator 15 securely (as shown in FIG. 2).

If for some reason the cocking actuator 15 is released, then the projection 21 attempts to pull the catch projection 25 toward the cocking actuator 15. Therefore, the catch projection 25 remains in its cocked position. In addition, a catch mechanism may also be provided to further secure the engagement between catch projection 25 and projection 21.

The operating handle 23 is a narrow grooved web arranged in the recess 3 next to the lug 9 of the cock 5. Handle 23 projects only slightly out of the handle 1 to the rear. This ensures that the operating handle 23 will not be operated inadvertently in handling the gun (e.g., when drawing the gun out of clothing or a pocket). On the other hand, the operating handle 23 can be operated easily with the user's thumb, optionally while manipulating the lug 9 of the cock 5, even if the user is wearing a heavy glove on the operating hand.

The cocking actuator safety mechanism shown here is installed in a handgun in the present example, but it could also be used equally well in longer weapons such as a rifle. Moreover, the gun using this safety mechanism need not be an automatic gun, as in the example shown here, but instead could equally be a repeating gun or a single loader or a gun with multiple barrels.

From the foregoing, persons of ordinary skill in the art will appreciate that the disclosed gun includes an additional safety which is independent of the trigger mechanism and which functions to secure the cocking actuator directly.

Cocking actuator safety mechanisms are known, but inasmuch as the cocking actuator is a cock with a handle, in the past the entire cock has been secured by the cocking actuator safety mechanism. It would, therefore, be self-evident to secure the cock (not the separate cocking actuator) with a firing pin piece safety mechanism, as in the known case. In fact, the illustrated gun has a firing pin piece safety mechanism 13 in addition to the cocking actuator safety mechanism described herein. Advantageously, striking of the cocking actuator 15 is prevented from the beginning in the safety mechanism illustrated herein so that optimal safety is guaranteed.

The cocking actuator safety mechanism disclosed herein can be combined with a second safety mechanism, so that in operation of this second conventional safety mechanism, the cocking actuator safety mechanism is also inserted or released in synchronism with the second safety mechanism. The illustrated cocking actuator safety mechanism could also be combined with the magazine shaft, for example, and could act as a magazine safety mechanism, so that it is automatically engaged when the magazine is removed.

The illustrated cocking actuator safety mechanism is designed to secure the entire cocking actuator 15. However, it can be modified so that it can also be used to secure the uncocked cocking actuator to thereby prevent the cock from being pulled back and, thus, prevent the breech movement in the case of a gun designed for such movement (e.g., an automatic pistol). If the illustrated cocking actuator safety mechanism is operated by a breech bolt or a similar device which protects the gun from unauthorized use, then locking of the uncocked cocking actuator 15 also at the same time prevents the gun from being loaded or unloaded.

The illustrated cocking actuator safety mechanism is provided with its own operating handle 23, so that it can be operated and released independently of other safety mechanisms. This does not rule out the possibility that it might also be combined with other safety mechanisms and engaged automatically, for example, when the magazine is removed.

This operating handle 23 may be designed as a conventional safety wing or as a handle safety clip, so that the weapon is automatically secured when taken out of the hand and the safety is automatically released when the grip, the front shaft, or the like is gripped securely with the hand.

However, in the preferred embodiment illustrated herein, the operating handle 23 of the cocking actuator safety mechanism is mounted in the area of movement of the cock 5 or the lug 9 of the cock 5. When the person using the gun grips the weapon with his thumb toward the cock 5 to bring the cock into its forward (i.e., uncocked) position with the cocking actuator 15 cocked, then he can optionally also operate the operating handle 23 with his thumb to thereby engage the cocking actuator safety mechanism. Conversely, when the person using the gun grips the cock 5 to retract it and thus move the trigger into the single-action position, he can also grip the operating handle 23 and, thus, deactivate the safety mechanism.

The illustrated cocking actuator safety mechanism may also be designed as a cam shaft which passes laterally through the handle 1 and reaches under a projection on the cocking actuator 15 when turned. Then the cocking actuator 15 can even be lifted out of the locking mechanism, so that there is no risk of the cocking actuator 15 firing in removing the safety mechanism.

In a preferred embodiment, the operating handle 23 sits on an end of an angle lever 17 which can be pivoted about a transverse axle 19, and the opposite end of the angle lever 17 can be engaged with a projection 21 on the periphery of the cocking actuator 15. The angle lever 17 extends around the cocking actuator 15 and, thus, reaches a position where there is a good possibility for the arrangement of the projection 25. On the other hand, the end of the angle lever 17 with the operating handle 23 reaches the especially favorable area of the range of movement of the lug 9 of the cock 5. This operating handle 23 can also be designed as a narrow grooved projection which is arranged next to the cock 5 and can be operated easily with the tip of the user's thumb, even when wearing heavy gloves.

The length of the two legs 17*a*, 17*b* of the angle lever 17 is selected to yield an appropriate movement distance for the handle 23. The design of the two legs 17*a*, 17*b* is such that their weight, based on the distance from the transverse axle 19, is substantially the same, so that an inertial force applied to the gun (e.g., when striking a hard substrate) cannot cause a tilting movement in the angle lever 17.

With regard to the position of the transverse axle 19, it is preferably located between the axis 7 of the cocked cocking actuator 15 and a tangent to the periphery of the cocked cocking actuator 15 in the vicinity of the projection 21. The force exerted by the projection 21 on the angle lever 17 which engages behind the projection 21, thus, has a component which tends to pull the angle lever 17 toward the cocking actuator 15. As a result, an especially reliable safety engagement is guaranteed.

The operating handle 23 is preferably located at the side next to the cock 5. The axis of the angle lever 17 is preferably above that of the cocking actuator 15 Thus, a position is found for the angle lever 17 at the side next to the parts of the trigger mechanism and the striking mechanism, which does not limit their design. In addition, the direction of operation of the operating handle 23 corresponds to the movement of the cock 15. The arc-shaped movement of the handle 23 forward and upward causes the safety locking, and the reverse movement releases the safety.

By an appropriate arrangement of its transverse axle 19, the angle lever 17 can be prevented from being released from the projection 21 on the cocking actuator 15 because it is pressed into engagement with it. However, the angle lever 17 could be engaged from its released position to the position behind the projection 21 if it could move too easily. This problem could be prevented by imparting a certain frictional resistance to the angle lever 17 to prevent the angle lever 17 from being moved inadvertently.

In a preferred embodiment, however, at least one locking mechanism is provided for the angle lever 17. This locking mechanism secures the angle lever 17 at least in the released position (unsecured position). The angle lever 17 can preferably also be secured in the safety position by a locking mechanism. This would prevent the position of the angle lever 17 from being altered inadvertently (e.g., due to grazing the clothing when drawing the gun). The angle lever 17 may instead or additionally be loaded by a spring 35 which always presses it against the cocking actuator 15. This spring 35 is preferably designed as a plate spring 35 and can, thus, be used in an extremely tight space.

The illustrated apparatus creates an additional safety device which ensures an additional safety in guns with a cocking actuator 15 that is separate from the cock 5 without making operation of these guns disproportionately difficult or delaying operation in an emergency.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A handgun having a trigger mechanism, the handgun comprising:

a cock for movement between a first cocked position and a first discharged position;

a cocking actuator which is separate from the cock, the cocking actuator having a second cocked position and a second discharged position; a striker spring loading the cocking actuator toward the second discharged position;

a safety mechanism for releasably securing the cocking actuator in the cocked position, the safety mechanism being independent of the trigger mechanism such that actuating the trigger mechanism will not move the cocking actuator from the cocked position unless the safety mechanism releases the cocking actuator.

2. A handgun as defined in claim 1, wherein the safety mechanism includes an operating handle.

3. A handgun as defined in claim 2, wherein the cock includes a projection, and the operating handle is located adjacent the projection.

4. A handgun as defined in claim 2, wherein the cocking actuator includes a projection, the safety mechanism includes an angle lever having a first end and a second end, the angle lever can be pivoted about an axis, the operating handle is located on the first end of the angle lever, and the second end of the angle lever can be brought into engagement with the projection on the cocking actuator to secure the cocking actuator in the cocked position.

5. A handgun as defined in claim 4, wherein the cocking actuator is pivotable about a cocking actuator axis, and wherein, when the cocking actuator is cocked, the axis of the angle lever is located between the axis of the cocking actuator and a tangent to a circle about the axis of the cocking actuator, the tangent passing through the projection on the cocking actuator.

6. A handgun as defined in claim 5, wherein the cock includes a projection, the operating handle is located adjacent the projection of the cock, and the axis of the angle lever is located above the cocking actuator axis.

7. A handgun as defined in claim 1, wherein the safety mechanism includes an angle lever and further comprising a catch mechanism for securing the angle lever in at least one of an engaged position and a released position, the angle lever securing the cocking actuator when the angle lever is in the engaged position, and the angle lever releasing the cocking actuator when the angle lever is in the released position.

8. A handgun as defined in claim 4 wherein the angle lever includes a first arm and a second arm, the first arm being positioned in a substantially horizontal position and the second arm being positioned in a substantially vertical position.

9. A handgun as defined in claim 8 wherein the first and second arms of the angle lever are disposed at substantially a right angle, and the angle lever defines a cavity in which the cocking actuator is located.

10. For use in a firearm including a trigger mechanism, a cock for movement between a first cocked position and a first discharged position, a cocking actuator which is separate from the cock, the cocking actuator having a second cocked position and a second discharged position, a safety mechanism comprising:

an angle lever including a first arm and a second arm, the first arm being positioned in a substantially horizontal position and the second arm being positioned in a substantially vertical position, the second arm having an end positioned to releasably engage the cooking actuator for releasably securing the cocking actuator in the cocked position, and the first arm including an operating handle for selectively pivoting the angle lever to disengage the first end from the cocking actuator, wherein the first and second arms of the angle lever are disposed at substantially a right angle, and the angle lever defines a cavity which is dimensioned to at least partially receive the cocking actuator.

11. A firearm comprising:

a cock;

a cocking actuator which is separate from the cock and which entrains the cock when the cock is in a first cocked position and the cocking actuator moves from a second cocked position to a discharged position;

a safety mechanism for releasably securing the cocking actuator in the second cocked position, the safety mechanism including an operating handle located adjacent the cock, wherein the operating handle and the cock are moved in substantially the same direction to ready the firearm for firing.

* * * * *